United States Patent [19]

Dreher

[11] 4,010,763

[45] Mar. 8, 1977

[54] ADJUSTABLE APPARATUS FOR CUTTING WRAPPERS FOR DOUBLE CIGAR BUNCHES OF DIFFERENT SIZES

[75] Inventor: Hans C. Dreher, Dallas, Pa.

[73] Assignee: Culbro Corporation, New York, N.Y.

[22] Filed: Dec. 18, 1975

[21] Appl. No.: 641,732

[52] U.S. Cl. ..... 131/33; 131/58; 83/346; 83/100

[51] Int. Cl.[2] ..... A24C 1/26; B23D 25/12

[58] Field of Search ..... 131/58, 32, 35, 105, 131/33, 34, 67; 83/300, 349, 346, 347, 100; 93/80, 81 R

[56] References Cited

UNITED STATES PATENTS

| | | | |
|---|---|---|---|
| 1,467,481 | 9/1923 | Jovine | 83/349 X |
| 3,147,755 | 9/1964 | Larsson | 131/29 X |
| 3,225,773 | 12/1965 | Gustavson | 131/35 X |
| 3,456,653 | 7/1969 | Sandquist | 83/100 X |
| 3,875,836 | 4/1975 | Hutchinson | 83/100 X |

*Primary Examiner*—Stephen C. Pellegrino
*Attorney, Agent, or Firm*—Paul W. Garbo

[57] ABSTRACT

An adjustable apparatus can cut V-shaped segments of different dimensions from continuous sheets so that the V-shaped segments of different dimensions are suitable for application as wrappers to double cigar bunches of different dimensions. The apparatus can also cut the two tails of each V-shaped segment into flag-shaped configurations which will permit the smooth application of the two tails to the opposite ends of double cigar bunches having rounded ends.

30 Claims, 5 Drawing Figures

ADJUSTABLE APPARATUS FOR CUTTING WRAPPERS FOR DOUBLE CIGAR BUNCHES OF DIFFERENT SIZES

BACKGROUND OF THE INVENTION

This invention relates to apparatus for cutting V-shaped segments from a continuous sheet and for varying the width of the V-shaped segments cut from the sheet.

In recent years a proposal was made for applying cigar wrappers on double cigar bunches so that after each double bunch was rolled into the wrapper it could be cut into two cigars. With this same objective, German patent No. 1,153,308 shows an apparatus wherein two tobacco leaves are separately die-cut to provide two leaf segments which are then brought together to form a V-configuration; a double cigar bunch is rolled into the two leaf segments while in the V-configuration and finally is cut into two cigars. Similarly, U.S. Pat. No. 3,794,048 shows two wrapper segments placed in a V-configuration and a double cigar bunch positioned to be rolled into the two wrapper segments. In the U.S. patent the application of the wrapper starts at both ends of the double cigar bunch whereas in the German patent it starts at the center of the double bunch.

Prior proposals for cutting cigar wrappers for application on double cigar bunches have involved complex and costly machinery or simplified equipment of unsatisfactory performance.

Accordingly, the object of this invention is to provide an improved apparatus for cutting V-shaped segments from a continuous sheet.

Another object is to provide such apparatus with simple means for varying the width of the V-shaped segments cut from the sheet.

A further object is to provide such apparatus with means for trimming the two opposite ends or tails of the V-shaped segments to form the flags known in the art of die-cutting cigar wrappers for cigars having rounded mouth ends or so-called finished heads.

These and other objects and advantages of the invention will be apparent from the description which follows.

SUMMARY OF THE INVENTION

In accordance with this invention, a continuous sheet is fed by a pair of opposed rollers, at least one of which is driven, while the leading end of the sheet is held against the cylindrical surface of a rotating suction drum having a peripheral speed greater than the speed at which the sheet is fed by the pair of opposed rollers. A V-shaped segment is cut from the leading end of the sheet when a V-shaped knife blade projecting outwardly a slight distance from the cylindrical surface of the suction drum and covered by the leading end of the sheet passes in rubbing contact with a stationary V-shaped narrow cutting anvil which is substantially complementary to the V-shaped knife blade. The complete cutting of the V-shaped segment from the sheet is achieved substantially instantaneously when the V-shaped knife blade presses through the sheet to contact the V-shaped cutting anvil.

Preferably, the internal angle formed by the two sides of the V-shaped cutting anvil is sightly larger, say about 1° larger, than the internal angle formed by the two sides of the V-shaped knife blade. This preferred arrangement of V-shaped cutting anvil and V-shaped knife blade is particularly advantageous in cutting V-shaped segments from a fibrous sheet because cutting starts with the apex of the V-shaped knife blade piercing through the sheet to contact the apex of the V-shaped cutting anvil and from there the cutting proceeds extremely rapidly along both sides of the V-shaped knife blade to both edges of the sheet. For this preferred slight difference in the internal angles it is very desirable that the sheet fed by the opposed rollers to the suction drum first pass around an idler roller that is reciprocable. This reciprocable roller is designed to pull the leading end of the sheet on the cylindrical surface of the rotating suction drum backward sufficiently to stop momentarily the movement of the leading end of the sheet each time the V-shaped knife blade passes in rubbing contact with the V-shaped cutting avail. Other known means may be used in lieu of the reciprocable idler roller for periodically stopping the movement of the leading end of the sheet with each cutting of a V-shaped segment therefrom.

The preferred slight difference in the internal angles achieves scissor-like cutting of the entire V-shaped segment in an instant. Before cutting the sheet, the V-shaped knife blade produces a smoothing-out effect by pushing any ripples in the sheet outwardly from the center of the sheet toward its two edges. The width of the V-shaped segment which corresponds to the length cut from the continuous sheet is simply changed by varying the speed of either the opposed driven rollers feeding the sheet or the suction drum. As known, the speed of the feed rollers or the suction drum may be changed by using a variable-speed electric drive motor or a variable-speed mechanism such as a gear speed-reducer. For example, at any given rotational speed of the suction drum, the width of the V-shaped segment cut from the sheet will be increased by feeding the sheet at a faster rate and will be decreased by feeding the sheet at a slower rate.

The V-shaped segment severed from the sheet is then removed from the cylindrical surface of the rotating suction drum in any of the known ways. However, in a preferred embodiment of the invention, a second rotating suction drum is nearly in contact with the first suction drum at a point on the first suction drum where the V-shaped segment has already been cut from the sheet and with both suction drums rotating in opposite directions the apex of the V-shaped segment enters the nip of the oppositely rotating suction drums. Suction is cut off in the known manner from the portion of the first suction drum which is nearly in contact with the second suction drum with the result that the V-shaped segment is transferred to the cylindrical surface of the second suction drum. Then two flag-shaped knives on a rotating member simultaneously come into rolling contact with the two tails of the V-shaped segment on the cylindrical surface of the second suction drum with the result that the portions of both tails are cut away to leave the opposite ends of the V-shaped segment with flag configurations adapted to be wrapped around the rounded ends of a double cigar bunch. Preferably, where the V-shaped segment has been cut from a fibrous sheet, the peripheral speed of the section suction drum should be slightly greater than the peripheral speed of the rotating flag-shaped knives. Thus, when the flag-shaped knives come into rolling contact with the cylindrical surface of the second suction drum there is also a slight slippage of the surface of the drum on the flag-shaped knives with the result that the fibers in the V-shaped segment are better severed by the slight dragging of the flag-shaped knives against the cylindrical surface of the second suction drum. Thereafter the V-shaped segment with a flag configuration at each of its two tails is transferred from the cylindrical surface of the rotating second suction drum in a known manner.

Desirably, a third suction drum rotating with its cylindrical surface nearly in contact with that of the second suction drum may be used to transfer the V-shaped segment from the second to the third drum in the same manner already explained for transferring the V-shaped segment from the first rotating suction drum to the second such drum. While on the third rotating suction drum, the V-shaped segment may be wrapped around a double cigar bunch by bringing the bunch into rolling contact with the cylindrical surface of the third suction drum so that the rolling double cigar bunch first contacts the apex of the V-shaped segment. With at least a dab of paste previously applied at the apex of the V-shaped segment on the third suction drum, the apex of the V-shaped segment adheres to the surface of the double bunch rolling thereover so that the V-shaped segment becomes wrapped around the rolling double bunch. This type of application of a wrapper to a cigar bunch by rolling the bunch over the wrapper while on a suction drum is disclosed in U.S. Pat. No. 3,794,048.

For a fuller understanding of the invention, the further description thereof will refer to the accompanying drawings.

DESCRIPTION OF PREFERRED EMBODIMENTS

Figure 1:
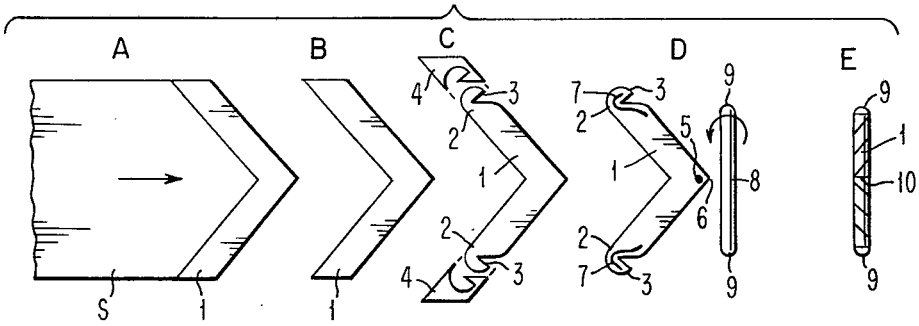
FIG. 1 is a schematic representation of the progress of the V-shaped segment from the moment it is cut until it is wrapped around a double cigar bunch in accordance with a preferred embodiment of the invention.

FIG. 1 shows at (A) the leading end of a continuous sheet S at the moment that V-shaped segment 1 has been cut therefrom. At (B) the cut segment 1 has been moved away from the leading end of sheet S and at (C) both tails 1 of V-shaped segment 1 have been die-cut to form flags 3 and discard pieces 4. At (D) V-shaped segment 1 has received a dab of paste 5 at its apex 6 and paste lines 7 at its tails 2 with flags 3; a double cigar bunch 8 with rounded ends 9 is shown just before it is rolled over V-shaped segment 1 with pastes 5 and 7 thereon. It should be noted that the length of double cigar bunch 8 is substantially equal to the vertical distance between the nearly horizontal cuts made to form flags 3 of segment 1 as shown at (D). At (E) V-shaped segment 1 has been completely wrapped around double bunch 8 and cut through midpoint 10 between rounded ends 9 to form two cigars with finished heads.

Figure 2:
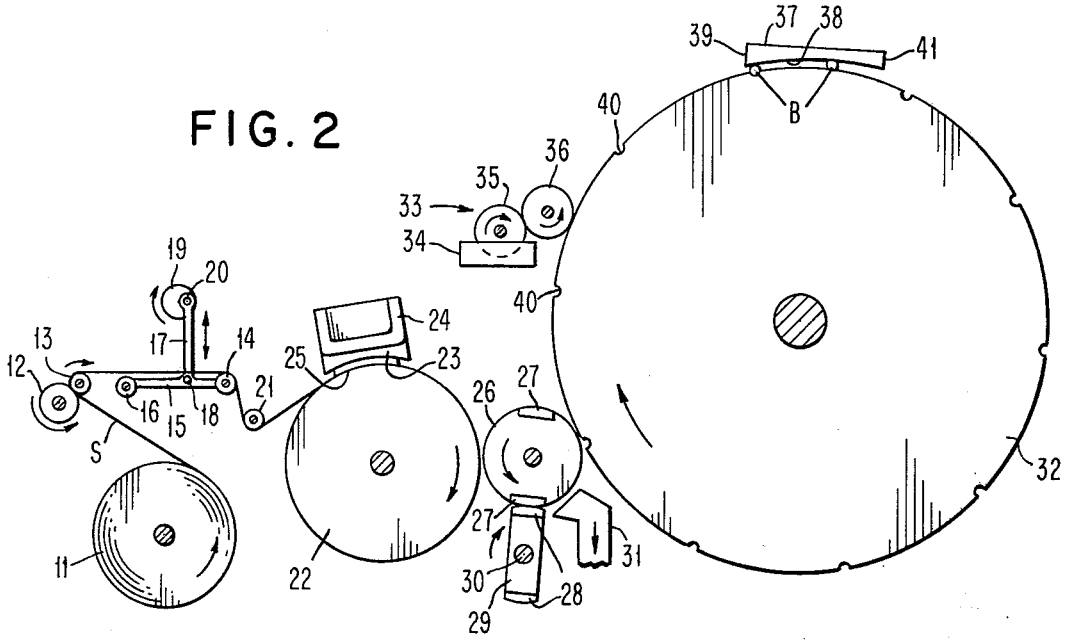
FIG. 2 is a schematic side view of an apparatus for performing the operations represented in FIG. 1.

FIG. 2 presents a schematic side view of the principal components of an apparatus suitable for carrying out the sequence of operations illustrated in FIG. 1. Tobacco wrapper sheet S is drawn from reel 11 thereof through opposed feed rollers 12, 13 at least one of which is a driven roller. Sheet S then passes over oscillating idler roller 14 mounted on arm 15 which is held on a stationary pivot 16. Link arm 17 is pivotally fastened to arm 15 at 18 and to rotating disk 19 at eccentric pivot 20. Sheet S continues from roller 14 around stationary idler roller 21 to first suction drum 22 which has several V-shaped knife blades equally spaced from one another and projecting slightly out of the cylindrical surface of drum 22. The leading end of sheet S held on suction drum 22 passes under block 23 which is preferably an integral part of fixed steel channel 24 and which has a narrow V-shaped cutting anvil 25 of hardened tool steel projecting slightly out of its concave bottom face. The V-shaped segment cut from the leading end of sheet S when one of the V-shaped knife blades on suction drum 22 passes in rubbing contact with V-shaped cutting anvil 25 of block 23 is carried by drum 22 to second suction drum 26 which is positioned so that its cylindrical surface nearly contacts that of drum 22. In the known manner, suction is not applied to the portion of the cylindrical surface of suction drum 26. Therefore the V-shaped segment on drum 22 is drawn to suction drum 26 where these oppositely rotating drums 22, 26 nearly contact one another. The reason for avoiding direct contact of the cylindrical surfaces of drums 22, 26 is that such contact would unnecessarily compress and possibly damage the V-shaped segment being transferred from drum 22 to drum 26.

Section suction drum 26 is provided with axially aligned pairs of anvil blocks 27 set in its cylindrical surface along the ends of drum 26. Axially aligned pairs of cutting blocks 28 fastened to arms 29 mounted on rotating shaft 30 pass in rolling and dragging contact with pairs of anvil blocks 27 in drum 26. Each cutting block 28 has a flag-shaped knife blade projecting slightly out of its arcuate face. When a V-shaped segment on suction drum 26 with its two tails positioned on a pair of anvil blocks 27 passes in rolling and slipping contact with a pair of cutting blocks 28 a portion of each tail is cut away to leave that tail in a flag-shaped configuration. The thus cut V-shaped segment on suction drum 26 is carried past suction head 31 which removes from drum 26 the portions of the two tails of the V-shaped segment which have been cut away by a pair of cutting blocks 28. The V-shaped segment with its two flag-shaped tails is carried by suction drum 26 to a point where its cylindrical surface nearly contacts the cylindrical surface of a third suction drum 32. At this point in suction drum 26 suction is cut off so that the V-shaped segment thereon is drawn by and transferred to the cylindrical surface of suction drum 32 as drum 32 rotates in the direction opposite to the rotational direction of drum 26. The cylindrical surfaces of drums 26, 32 are disposed with a slight clearance between them to avoid pressing the V-shaped segment being transferred from drum 26 to drum 32.

Suction drum 32 carries each successive V-shaped segment past adhesive paste applicator 33 comprising paste receptacle pan 34, paste pick-up roll 35 disposed with its lower portion immersed in the paste in pan 34 and transfer roll 36 which contacts roll 35 and periodically is brought into contact with each V-shaped segment on drum 32. The cylindrical surface of roll 36 has raised portions designed to apply a dab of paste at the apex of each V-shaped segment and a curved line of paste on each of the two flag-shaped tails of each successive V-shaped segment. A fixed plate 37 is adjustably disposed with its arcuate face 38 spaced from the cylindrical surface of suction drum 32 by a distance substantially equal to the diameter of the double cigar bunches B which are to be wrapped with the V-shaped segments. By known means, a double cigar bunch B is at regular intervals placed on the cylindrical surface of drum 32 ahead of entry end 39 of plate 37. Desirably, the cylindrical surface of drum 32 has several shallow grooves 40 parallel to the axis of drum 32 and equally spaced from one another. A double cigar bunch B is held with suction in each groove 40 as it approaches entry end 39 of plate 37. As drum 32 continues to rotate, the double cigar bunch B contacts concave face 38 of plate 37 with the result that the bunch B leaves its groove 40 while rolling back over the cylindrical surface of drum 32.

Each V-shaped segment is supplied to suction drum 32 so that its apex is adjacent a groove 40. Consequently when a double cigar bunch B at entry end 39 of plate 37 begins to roll back on the cylindrical surface of drum 32 it also rolls over the apex of V-shaped segment. The portion of the cylindrical surface of drum 32 together with grooves 40 therein extending clockwise from just before entry end 39 of plate 37 to the vicinity of drum 26 does not have suction applied to it. Inasmuch as a dab of adhesive paste has previously been applied to the apex of each V-shaped segment, the apex of the segment sticks to the bunch B rolling thereover so that the segment becomes wrapped around the rolling bunch B. By the time that rotating drum 32 has brought the rolling bunch B to discharge end 41 of plate 37, the V-shaped segment of tobacco sheet has been completely wrapped around bunch B. As soon as the wrapped bunch is moved by drum 32 beyond discharge end 41 of plate 37, any known means may be used to convey the wrapped bunch away from drum 32.

Fixed plate 37 together with rotating drum 32 effects rolling of each double cigar bunch into a V-shaped segment of tobacco sheet wrapper. If the bunch is substantially cylindrical or only slightly tapered at its opposite ends, the tails of each V-shaped segment do not have to be cut into flag-shaped configurations and the bunch leaving plate 37 at discharge end 41 will have been completely wrapped by the V-shaped segment and even the tails of the segment will have been wrapped around the opposite ends of the bunch. At most, such completely wrapped double cigar bunch will require only smoothing of the tails of the V-shaped segment at the opposite ends of the bunch either manually or mechanically with any known knurling device. Of course, when the tails of the V-shaped segment are not to be cut into flag-shaped configurations, die-cutters 28 are eliminated.

When the double cigar bunch has rounded or well tapered ends, the tails of the V-shaped segment to be wrapped around the bunch require trimming by appropriate die-cutters 28. In such case, the rolling of the bunch into the V-shaped segment effected by plate 37 and rotating drum 32 fails to make the tails of the segment contact the rounded or otherwise shaped ends of the bunch. Therefore, the appropriately trimmed tails of the V-shaped segment must be brought into smooth contact with the shaped ends of the bunch either by hand or by a specially developed apparatus. In all cases, the adhesive paste applied to the tails of the V-shaped segment by paste applicator 36 will make the tails stick to the opposite ends of the completely wrapped cigar bunch.

Figure 3:
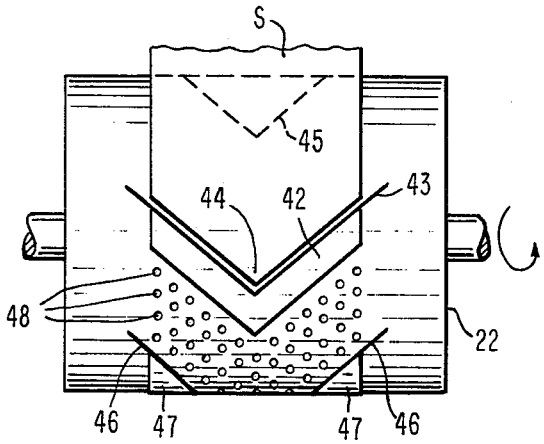
FIG. 3 is an enlarged top view of the suction drum in FIG. 2 on which the V-shaped segments are cut from a continuous sheet.

FIG. 3 is an enlarged top view of suction drum 22 with steel channel 24 removed to show sheet S at the moment when a V-shaped segment 42 has been cut therefrom by V-shaped knife blade 43. A feature of the invention is that two equal lengths of a flat steel blade can be set in a V-shaped slot in the cylindrical surface of drum 22 to form the V-shaped knife blade 43. The cutting edge of each length of steel blade is made arcuate so the cutting edge projects slighly, say about 2 millimeters, from the cylindrical surface of drum 22.

Immediately following the moment represented by FIG. 3, the continuing rotation of suction drum 22 conveys V-shaped segment 42 to second suction drum 26 while new leading end 44 of sheet S gradually slides back on the cylindrical surface of drum 22 because the superficial speed of drum 22 is intentionally greater than the speed at which sheet S is being fed by feed rollers 12, 13. When the next V-shaped knife blade 43 on drum 22 reaches the position shown in FIG. 3, the portion of sheet S lying over blade 43 will again be cut by blade 43, passing in rubbing contact with V-shaped cutting anvil 25 of block 23. At the instant of cutting, oscillating idler roller 14 moves to a position which pulls sheet S backward on drum 22 sufficiently so that at that instant leading end 44 of sheet S is at a standstill, i.e., it is not moving even though drum 22 continues to rotate. Oscillating roller 14 may be replaced by other means for periodically stopping the movement of leading end 44 of sheet S such as opposed rollers between which sheet S passes and which have a timed brake that momentarily stops the rotation of the opposed rollers each time a V-shaped segment is cut from sheet S. Also, such other means may be associated with feed rollers 12, 13 to effect momentary discontinuance of the rotation thereof with each cutting of a V-shaped segment from sheet S.

V-shaped cutting anvil 25 projecting downwardly from block 23 is about 3 millimeters wide and arcuate like V-shaped knife blade 43 so that every portion of the edge of blade 43 rubs across the narrow face of anvil 25 when rotating drum 22 brings each of its equally spaced V-shaped knife blades 43 into sweeping contact with stationary cutting anvil 25. Preferably, the internal angle formed by the two sides of V-shaped cutting anvil 25 is slightly larger, say about 1° larger, than the internal angle formed by the two sides of each V-shaped knife blade 43. This small angular difference provides a raking effect starting at the apex of knife blade 43 and very rapidly moving down both its sides at the moment of cutting sheet S. Thus sheet S is kept smooth on rotating drum 22 and any tendency of both side edges of sheet S to move toward its center is overcome.

Drum 22 shown in FIG. 3 has four V-shaped knife blades 43 equally spaced from one another. Apex portion 45 of the next knife blade 43 which will cut another V-shaped segment 42 from leading end 44 of sheet S is below sheet S. Ahead of V-shaped segment 42 on drum 22 are both tail portions 46 of a knife blade 43 as well as both tail portions 47 of a previously cut V-shaped segment 42. The cylindrical surface of drum 22 has a multiplicity of perforations 48 through which suction is applied to hold both sheet S and V-shaped segment 42 on the surface of drum 22.

Figure 4:
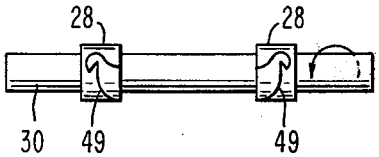
FIG. 4 is an enlarged top view of the two flag-shaped knives on a rotating member in FIG. 2 which cut away portions of both tails of each V-shaped segment.

FIG. 4 is a top view of die-cutters 28 in FIG. 2 on the same enlarged scale of FIG. 3. FIG. 4 omits suction drum 26. Each diecutter 28 has a knife-like edge 49 projecting outwardly, say about 2 millimeters, from its outer face in the desired flag-shaped configuration which is to be cut into each of the two tails of V-shaped segment 42. The two die-cutters 28 are fastened to the ends of two arms 29 mounted at their centers on rotating shaft 30. The opposite ends of arms 29 have another pair of die-cutters 28 fastened thereto. For a V-shaped segment having sides longer than those of segment 42 in FIG. 3, the two arms 29 mounted on shaft 30 are moved further apart while these arms 29 are moved closer together for a V-shaped segment having sides shorter than those of segment 42 in FIG. 3. In brief, the distance between die-cutters 28 is adjustable for different widths of sheet S.

Figure 5:
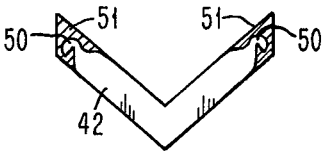
FIG. 5 is a view of a V-shaped segment at the moment it has passed the flag-shaped knives of FIG. 4.

FIG. 5 on the same scale of FIGS. 3 and 4 shows V-shaped segment 42 just after its two tails have been cut into flag-shaped configurations 50 and discardable pieces 51 by a pair of die-cutters 28 rolling over the two tails positioned on a pair of anvils 27 in rotating drum 26. The two cut pieces 51 (shown with hatch lines for better understanding) are removed from rotating drum 26 as they move across the open mouth of suction head 31.

In an exemplary embodiment of the invention, first suction drum 22 with four V-shaped knife blades 43 has an outside diameter of 42.04 centimeters, second suction drum 26 a diameter of 21.02 centimeters and third suction drum 32 a diameter of 105.10 centimeters. The outer faces of die-cutters 28 on opposite ends of arms 29 have a diametrical distance of 20.6 centimeters therebetween. Drum 32 is 38 centimeters wide and has ten grooves 40 equally spaced on its cylindrical surface for positioning and holding the double cigar bunches brought to plate 37. Sheet S with a width of 27.94 centimeters is fed by rollers 12, 13 at such a rate relative to the peripheral speed of drum 22 that each V-shaped segment 42 cut therefrom measures 4.29 centimeters along the length of sheet S. The internal angle formed by the two sides of the V-shaped segment 42 is 100°. With drums 22, 26 and 32 rotating at speeds of 62.5, 125 and 25 revolutions per minute, respectively, double cigar bunches measuring 1.15 centimeters in diameter and 23.85 centimeters in length are wrapped in the V-shaped segments at the rate of 250 double bunches per minute. Inasmuch as each wrapped double bunch is cut into two equal cigars, the production rate of the illustrative apparatus corresponds to 500 cigars per minute.

The versatility of the specific apparatus just described is evident because it can be supplied with sheets of different widths for double cigar bunches of different lengths. Also, double cigar bunches of different diameters can be wrapped in V-shaped tobacco sheet segments of different widths. As previously explained, the width of the V-shaped segments cut from the tobacco sheet is readily changed by adjusting the rate at which the sheet is fed by opposed rollers 12, 13. Alternatively, rollers 12, 13 may feed the sheet at a fixed rate and the rotational speed of suction drum 22 may be increased or decreased to cut V-shaped segments of smaller or greater widths, respectively. The ease of changing the width of the V-shaped segments cut pursuant to the invention is of value in setting the amount of overlap that each V-shaped segment will have when helically wrapped around a double cigar bunch of a given diameter as well as in providing V-shaped segments of suitable widths for double bunches of different diameters. Adjustable plate 37 is also simply placed closer to or further from the cylindrical surface of drum 32 according to the diameter of the double cigar bunches to be wrapped in the V-shaped segments.

Various modifications of the invention will be apparent from the foregoing disclosure. For instance, die-cutters 28 can be mounted in a cylindrical drum in the same way that anvil blocks 27 are mounted in drum 26. Similarly, it is known that plate 37 may be replaced by an endless flexible belt movable clockwise in harmony with the clockwise rotation of drum 32 shown in FIG. 2. Accordingly, only such limitations should be imposed on the scope of the invention as are set forth in the appended claims.

What is claimed is:

1. Apparatus for dispensing a continuous sheet in the form of V-shaped segments of predetermined width measured along the length of said sheet which comprises adjustable means for feeding said sheet at a predetermined rate, a rotatable suction drum for holding the leading end of said sheet thereon, at least one V-shaped knife blade projecting slightly from the cylindrical surface of said suction drum into contact with said leading end of said sheet, a V-shaped narrow cutting anvil projecting slightly from the concave face of a block fixed relative to said suction drum so that all of said V-shaped knife blade passes in substantially instantaneous rubbing contact with said V-shaped anvil during the rotation of said suction drum, and means for removing from said suction drum each V-shaped segment cut from said sheet by the passage of said V-shaped knife blade covered with said leading end of said sheet in rubbing contact with said V-shaped anvil.

2. The apparatus of claim 1 wherein the internal angle formed by the two sides of the V-shaped cutting anvil is about 1° greater than the internal angle formed by the two sides of the V-shaped knife blade.

3. The apparatus of claim 1 which includes means for periodically stopping the movement of the leading end of the sheet each time a V-shaped knife blade passes in rubbing contact with the V-shaped narrow cutting anvil.

4. The apparatus of claim 3 wherein the means for periodically stopping the movement of the leading end of the sheet is a reciprocable idle roller around which said sheet passes from the means for feeding said sheet to the suction drum.

5. The apparatus of claim 4 wherein the internal angle formed by the two sides of the V-shaped cutting anvil is about 1° greater than the internal angle formed by the two sides of the V-shaped knife blade.

6. The apparatus of claim 5 wherein the means for removing from the suction drum each V-shaped segment cut from the sheet is a second rotatable suction drum disposed with its cylindrical surface nearly in contact with the cylindrical surface of the first-mentioned suction drum, the axes of both said drums being disposed in parallel.

7. The apparatus of claim 1 wherein the means for removing from the suction drum each V-shaped segment cut from the sheet is a second rotatable suction drum disposed with its cylindrical surface nearly in contact with the cylindrical surface of the first-mentioned suction drum, the axes of both said drums being disposed in parallel.

8. The apparatus of claim 7 which includes rotatable means having at least one adjustable pair of curved die-cutters on its periphery, the axes of said rotatable means and the second suction drum being so disposed in parallel that said die-cutters pass in rolling contact with the cylindrical surface of said second suction drum during the rotation of said rotatable means and said second suction drum, said pair of said die-cutters being adjustably positioned to pass in rolling contact with the two tails of a V-shaped segment on said second suction drum and thereby to cut a curved portion from each of said two tails of said V-shaped segment.

9. The apparatus of claim 8 which includes an open suction head disposed adjacent the cylindrical surface of the second suction drum to remove the curved portions cut from the two tails of a V-shaped segment.

10. The apparatus of claim 8 wherein the internal angle formed by the two sides of the V-shaped cutting anvil is about 1° greater than the internal angle formed by the two sides of the V-shaped knife blade.

11. The apparatus of claim 10 wherein the peripheral speed of the second suction drum is slightly greater than the peripheral speed of the pair of die-cutters.

12. Apparatus for dispensing a continuous tobacco sheet in the form of V-shaped segments of predetermined width measured along the length of said sheet which comprises means for feeding said sheet, a rotatable suction drum for holding the leading end of said sheet thereon, the peripheral speed of said suction drum being greater than the rate at which said sheet is fed by said means for feeding said sheet, means for adjusting the difference between said peripheral speed and said rate at which said sheet is fed, at least one V-shaped knife blade projecting slightly from the cylindrical surface of said suction drum into contact with said leading end of said sheet, a V-shaped narrow cutting anvil that is substantially complementary to said V-shaped knife blade projecting slightly from the concave face of a block fixed relative to said suction drum so that all of said V-shaped knife blade passes in rubbing contact with said V-shaped anvil during rotation of said suction drum, and means for removing from said suction drum each V-shaped segment cut from said sheet by the passage of said V-shaped knife blade covered with said leading end of said sheet in rubbing contact with said V-shaped anvil.

13. The apparatus of claim 12 wherein the internal angle formed by the two sides of the V-shaped cutting anvil is about 1° greater than the internal angle formed by the two sides of the V-shaped knife blade.

14. The apparatus of claim 13 which includes means for periodically stopping the movement of the leading end of the tobacco sheet each time a V-shaped knife blade passes in rubbing contact with the V-shaped narrow cutting anvil.

15. The apparatus of claim 12 wherein the means for removing from the suction drum each V-shaped segment cut from the tobacco sheet is a second rotatable suction drum disposed with its cylindrical surface nearly in contact with the cylindrical surface of the first-mentioned suction drum, both said drums rotating in opposite directions on axes disposed in parallel.

16. The apparatus of claim 15 which includes rotatable means having at least one adjustable pair of flag-shaped die-cutters on its periphery, the axes of said rotatable means and the second suction drum being so disposed in parallel that said die-cutters pass in rolling contact with the cylindrical surface of said second suction drum during rotation of said rotatable means and said second suction drums, said pair of said diecutters being adjustably positioned to pass in rolling contact with the two tails of a V-shaped segment on said second suction drum and thereby to cut each of said two tails of said V-shaped segment into a flag-shaped configuration.

17. The apparatus of claim 16 which includes an open suction head disposed adjacent the cylindrical surface of the second suction drum to remove the portions cut from the two tails of a V-shaped segment.

18. The apparatus of claim 16 wherein the peripheral speed of the second suction drum is slightly greater than the peripheral speed of the pair of die-cutters.

19. The apparatus of claim 18 wherein the internal angle formed by the two sides of the V-shaped cutting anvil is about 1° greater than the internal angle formed by the two sides of the V-shaped knife blade.

20. The apparatus of claim 16 which includes a third rotatable suction drum disposed with its cylindrical surface nearly in contact with the cylindrical surface of the second suction drum, the axes of both said drums being disposed in parallel and the suctions of both said drums being controlled to effect the transfer of each V-shaped segment from said second drum to said third drum during the rotation of both said drums in opposite directions, an applicator to place adhesive on each V-shaped segment transferred to said third drum, and rolling means to wrap each V-shaped segment with said adhesive thereon helically around a double cigar bunch by rolling said bunch on the cylindrical surface of said third drum over said V-shaped segment.

21. The apparatus of claim 20 wherein the rolling means is a member with a concave face which is adjustably spaced from the cylindrical surface of the third suction drum in relation to the diameter of the double cigar bunches rolled by said concave face with the rotation of said third drum.

22. The apparatus of claim 20 wherein the three rotatable suction drums have the same peripheral speed and the means for feeding the tobacco sheet is adjustable in the rate at which said sheet is fed.

23. The apparatus of claim 22 wherein the internal angle formed by the two sides of the V-shaped cutting anvil is about 1° greater than the internal angle formed by the two sides of the V-shaped knife blade and the peripheral speed of the second suction drum is slightly greater than the peripheral speed of the pair of die-cutters.

24. The apparatus of claim 23 which includes a reciprocable idler roller for periodically stopping the movement of the leading end of the tobacco sheet each time a V-shaped knife blade passes in rubbing contact with the V-shaped narrow cutting anvil, said idler roller being disposed so that said sheet passes thereover from the means for feeding said sheet.

25. The apparatus of claim 24 wherein the rolling means is a member with a concave face which is adjustably spaced from the cylindrical surface of the third suction drum in relation to the diameter of the double cigar bunches rolled by said concave face with the rotation of said third drum.

26. Apparatus for helically wrapping double cigar bunches with V-shaped segments cut from a continuous tobacco sheet which comprises means for feeding said sheet, a first rotatable suction drum for holding the leading end of said sheet on its cylindrical surface, a plurality of V-shaped knife blades projecting slightly from said cylindrical surface of said first drum and equally spaced from one another, a V-shaped cutting anvil that is substantially complementary to each of said V-shaped knife blades projecting from the concave face of a block fixed relative to said first drum so that all of each of said V-shaped knife blades passes in rubbing contact with said V-shaped anvil during rotation of said first drum, a parallel second rotatable suction drum disposed with its cylindrical surface nearly in contact with said cylindrical surface of said first drum and adapted to transfer each V-shaped segment cut from said sheet by the passage of one of said V-shaped knife blades covered with said leading end of said sheet in rubbing contact with said V-shaped anvil to said cylindrical surface of said second drum, means for cutting the two tails of each V-shaped segment on said cylindrical surface of said second drum into flag-shaped configurations, a parallel third rotatable suction drum disposed with its cylindrical surface nearly in contact with said cylindrical surface of said second drum and adapted to transfer each V-shaped segment with its two tails cut into flag-shaped configurations to said cylindrical surface of said third drum, all three of said drums having the same peripheral speed which is greater than the rate at which said sheet is fed by said means for feeding said sheet, and means for helically wrapping each V-shaped segment on said third drum arund a double cigar bunch by rolling said bunch on said cylindrical surface of said third drum over said V-shaped segment.

27. The apparatus of claim 26 wherein the means for feeding the tobacco sheet is adjustable in the rate at which said sheet is fed and the means for helically wrapping each V-shaped segment is adjustable in relation to the diameter of the double cigar bunch to be wrapped by said V-shaped segment.

28. The apparatus of claim 27 wherein the internal angle formed by the two sides of the V-shaped cutting anvil is about 1° greater than the internal angle formed by the two sides of each V-shaped knife blade and means are provided for stopping momentarily the movement of the leading end of the tobacco sheet each time each said V-shaped knife blade covered with said leading end of said sheet passes in rubbing contact with said V-shaped cutting anvil.

29. The apparatus of claim 28 wherein the means for cutting the two tails of each V-shaped segment on the cylindrical surface of the second drum comprise at least one adjustable pair of flag-shaped die-cutters on the periphery of rotatable means, the axes of said rotatable means and said second drum being so disposed in parallel that said die-cutters pass in rolling contact with said cylindrical surface of said second drum during rotation of said rotatable means and said second drum, said pair of said die-cutters being adjustably positioned to pass in rolling contact with the two tails of a V-shaped segment on said second drum and thereby to cut each of said two tails of said V-shaped segment into a flag-shaped configuration.

30. The apparatus of claim 29 wherein the peripheral speed of the first rotatable suction drum is greater than the rate at which the tobacco sheet is fed by the means for feeding said sheet, the second and third rotatable suction drums have the same peripheral speed of said first suction drum, and the pair of flag-shaped diecutters has a peripheral speed slightly less than said same peripheral speed of all three rotatable suction drums.

* * * * *

UNITED STATES PATENT OFFICE
CERTIFICATE OF CORRECTION

PATENT NO. : 4,010,763

DATED : March 8, 1977

INVENTOR(S) : Hans C. Dreher

It is certified that error appears in the above-identified patent and that said Letters Patent are hereby corrected as shown below:

Column 2, line 17, "avail" should read -- anvil --; line 62 "section" should read -- second --.
Column3, line 54, "tails 1" should read -- tails 2--.
Column 4, line 24, after "surface" insert -- of drum 22 where it nearly contacts the cylindrical surface --; line 32, "Section" should read --Second --.
Column 7, line 31, "20.6" should read -- 20.16 --.
Column 8, line 45, "idle" should read -- idler --.
Column 9, line 67, "drums" should read -- drum -- and "diecutters" should read -- die-cutters --.
Column 11, line 25, "arund" should read -- around --.

Signed and Sealed this

Tenth Day of May 1977

[SEAL]

*Attest:*

RUTH C. MASON
*Attesting Officer*

C. MARSHALL DANN
*Commissioner of Patents and Trademarks*